US009870756B2

(12) United States Patent
Chen et al.

(10) Patent No.: US 9,870,756 B2
(45) Date of Patent: Jan. 16, 2018

(54) DISPLAY PANEL

(71) Applicant: Chunghwa Picture Tubes, LTD., Taoyuan (TW)

(72) Inventors: Yi-Kai Chen, Tainan (TW); Chi-Chung Tsai, Kinmen County (TW); En-Chih Liu, Taoyuan (TW); Ying-Hui Chen, Taoyuan (TW); Yen-Yu Huang, Taoyuan (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 397 days.

(21) Appl. No.: 14/644,977

(22) Filed: Mar. 11, 2015

(65) Prior Publication Data

US 2016/0189683 A1 Jun. 30, 2016

(30) Foreign Application Priority Data

Dec. 30, 2014 (TW) ..... 103146256 A

(51) Int. Cl.
*G09G 3/36* (2006.01)
*G09G 5/18* (2006.01)

(52) U.S. Cl.
CPC ..... *G09G 5/18* (2013.01); *G09G 3/3677* (2013.01); *G09G 3/3696* (2013.01); *G09G 2310/0286* (2013.01)

(58) Field of Classification Search
CPC ..... G06G 5/18; G06G 3/3696
USPC ..... 345/100, 99
See application file for complete search history.

(56) References Cited

U.S. PATENT DOCUMENTS 8,571,169 B2 10/2013 Tobita
9,208,742 B2 * 12/2015 Miyake ..... G09G 3/3677

FOREIGN PATENT DOCUMENTS

| | | |
|---|---|---|
| JP | 2010054026 | 3/2010 |
| TW | 201040912 | 11/2010 |
| TW | I420495 | 12/2013 |

OTHER PUBLICATIONS

"Office Action of Taiwan Counterpart Application" , dated Mar. 15, 2016, p. 1-p. 5.

* cited by examiner

*Primary Examiner* — William Boddie
*Assistant Examiner* — Leonid Shapiro
(74) *Attorney, Agent, or Firm* — J.C. Patents

(57) ABSTRACT

A display panel including a pixel array and a gate driver circuit is provided. The pixel array has a plurality of pixels. The gate driver circuit is used for providing a plurality of gate signals to the pixels and includes a plurality of shift registers and a plurality of demultiplexers. The shift registers respectively receive a first gate signal of the gate signals and a first clock signal of a plurality of clock signals to respectively provide a first control signal and a second control signal. The demultiplexers respectively receive a plurality of second clock signals of the clock signals, respectively turn-on according to the first control signal provided by the corresponding one of the shift registers, and respectively cut-off according to the second control signal provided by the corresponding one of the shift registers.

8 Claims, 5 Drawing Sheets

DISPLAY PANEL

CROSS-REFERENCE TO RELATED APPLICATION

This application claims the priority benefit of Taiwan application serial no. 103146256, filed on Dec. 30, 2014. The entirety of the above-mentioned patent application is hereby incorporated by reference herein and made a part of this specification.

BACKGROUND OF THE INVENTION

1. Field of the Invention

The invention relates to a display panel, and relates particularly to a display panel having a gate driver circuit.

2. Description of Related Art

Along with developments in optoelectronics and semiconductor technology, flat panel displays have been widely used recently, and are replacing cathode ray tube (CRT) monitors as a mainstream monitor of the next generation. Using a liquid crystal display (LCD) panel as an example, which mainly comprise of an active component array substrate, an opposite substrate and a display component sandwiched between the active component array substrate and the opposite substrate, wherein the active component array substrate has a plurality of pixels arranged in an array. For aesthetic effects for the exterior and a special visual experience, a trend nowadays is to make the display panel conform to narrow border design requirements. However, due to increasing user demand for picture quality, the resolution of pictures is increasing as well. Therefore, the conductive circuits disposed in the periphery circuit area are bound to be more and more and making it difficult to achieve design requirements, and thus how to take into account the quality of the display panel and the narrow border design requirements are a goal to pursue for those skilled in the art.

SUMMARY OF THE INVENTION

The invention provides a display panel, which may reduce the number of transistors disposed on the gate driver circuit of the display panel, to narrow the border of the display panel.

The display panel of the invention includes a pixel array and a gate driver circuit. The pixel array has a plurality of pixels. The gate driver circuit is coupled with the pixels to provide a plurality of gate signals, and includes a plurality of shift registers and a plurality of demultiplexers. The shift registers respectively receive a first gate signal of the gate signals and a first clock signal of a plurality of clock signals, to respectively provide a first control signal and a second control signal, wherein the clock signals are sequentially enabled. The demultiplexers respectively receive a plurality of second clock signals of the clock signals, and are coupled to the corresponding shift register to receive the corresponding first control signal and the corresponding second control signal, wherein each of the demultiplexers are turned-on according to the corresponding first control signal, to provide the gate signals according to the second clock signals, and each of the demultiplexers are cut-off according to the corresponding second control signal.

Based on the above, a display panel of the embodiments of the invention divides a gate driver circuit into shift registers for controlling timing and demultiplexers for outputting a plurality of clock signals. In this way, the number of transistors disposed on the gate driver circuit of the display panel may be reduced, to narrow the border of the display panel.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
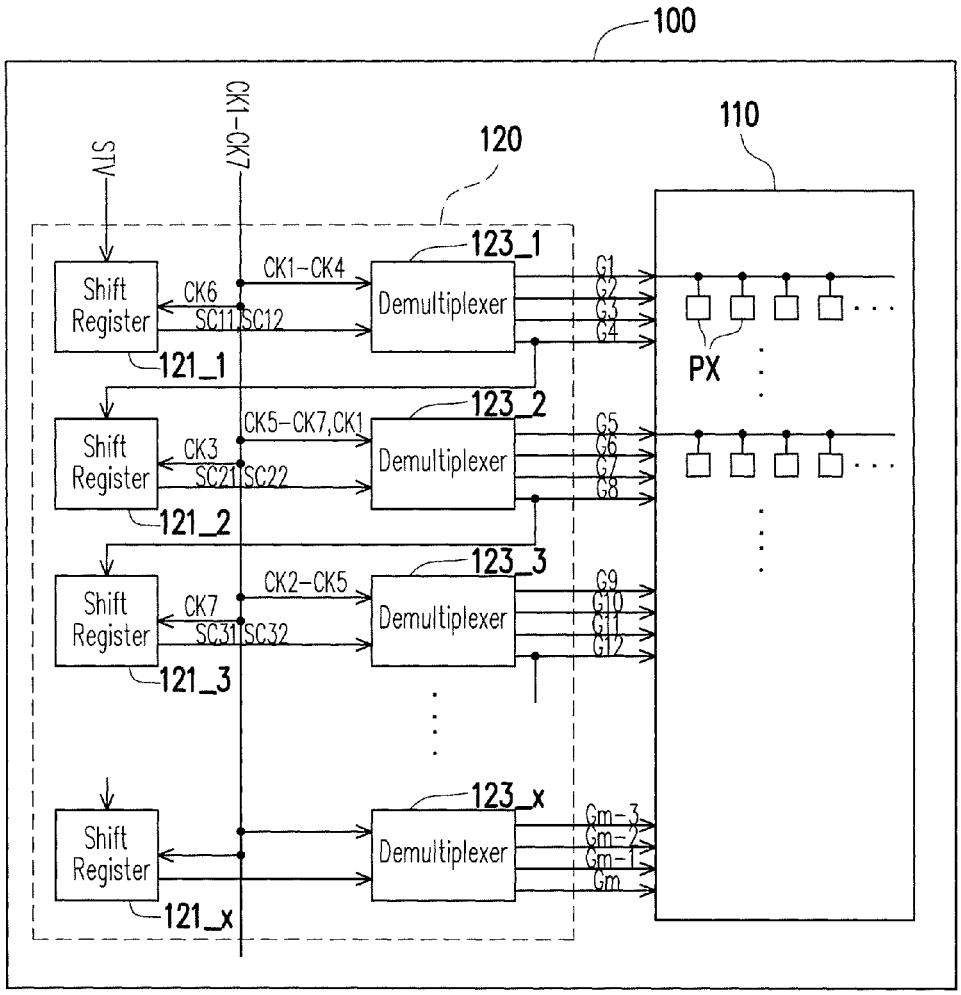
FIG. 1 is a schematic diagram illustrating a system for a display panel according to and embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic diagram illustrating a system for a display panel according to an embodiment of the invention. Referring to FIG. 1, in the present embodiment, a display panel 100, for example, includes a pixel array 110 and a gate driver circuit 120. The pixel array 110 has a plurality of pixels PX, and the pixels PX, for example, are arranged in an array. The gate driver circuit 120 is coupled to the pixels PX to provide a plurality of gate signals (for example G1~Gm), and the gate driver circuit 120, for example, includes a plurality of shift registers (for example 121_1~121_*x*) and a plurality of demultiplexers (for example 123_1~123_*x*), wherein x is a positive integer, and m is a multiple of x (here 4 times). Furthermore, each shift register (for example 121_1~121_*x*) coupled with the demultiplexer (for example 123_1~123_*x*) may be regarded as a gate signal generating unit of one stage.

The shift registers 121_1~121_*x* respectively receive an initial signal STV or the last gate signal provided by the gate signal generating unit of the previous stage (for example G1~Gm, corresponding to the first gate signal), and one of the clock signals CK1~CK7 (corresponding to the first clock signal), to respectively provide first control signals (for example SC11~SC31) and second control signals (for example SC12~SC32), wherein the clock signals CK1~CK7 may be individually transmitted through the line or transmitted through a bus, but however the embodiments of the invention are not limited thereto. Furthermore, the clock signals CK1~CK7 are sequentially enabled, namely the enabled periods of the clock signals CK1~CK7 do not overlap, and the initial signal STV may be regarded as a reserved gate signal.

The demultiplexers 123_1~123_*x* respectively receive a part of the clock signal CK1~CK7 (corresponding to the second clock signals), and are coupled to the corresponding shift register (for example 121_1~121_x) to receive the corresponding first control signal (for example SC11~SC31) and the second control signal (for example SC12~SC32), wherein each of the demultiplexers 123_1~123_x are turned-on according to the corresponding first control signal (for example SC11~SC31), to provide the gate signal (for example G1~Gm) according to the received clock signals (for example CK1~CK7), and each of the demultiplexers 123_1~123_x are cut-off according to the corresponding second control signal (for example SC12~SC32).

Wherein, the clock signal (CK1~CK7) received by each of the shift registers (for example 121_1~121_x) is different than the clock signals (CK1~CK7) received by the coupled demultiplexer (for example 123_~123_x).

Figure 2:
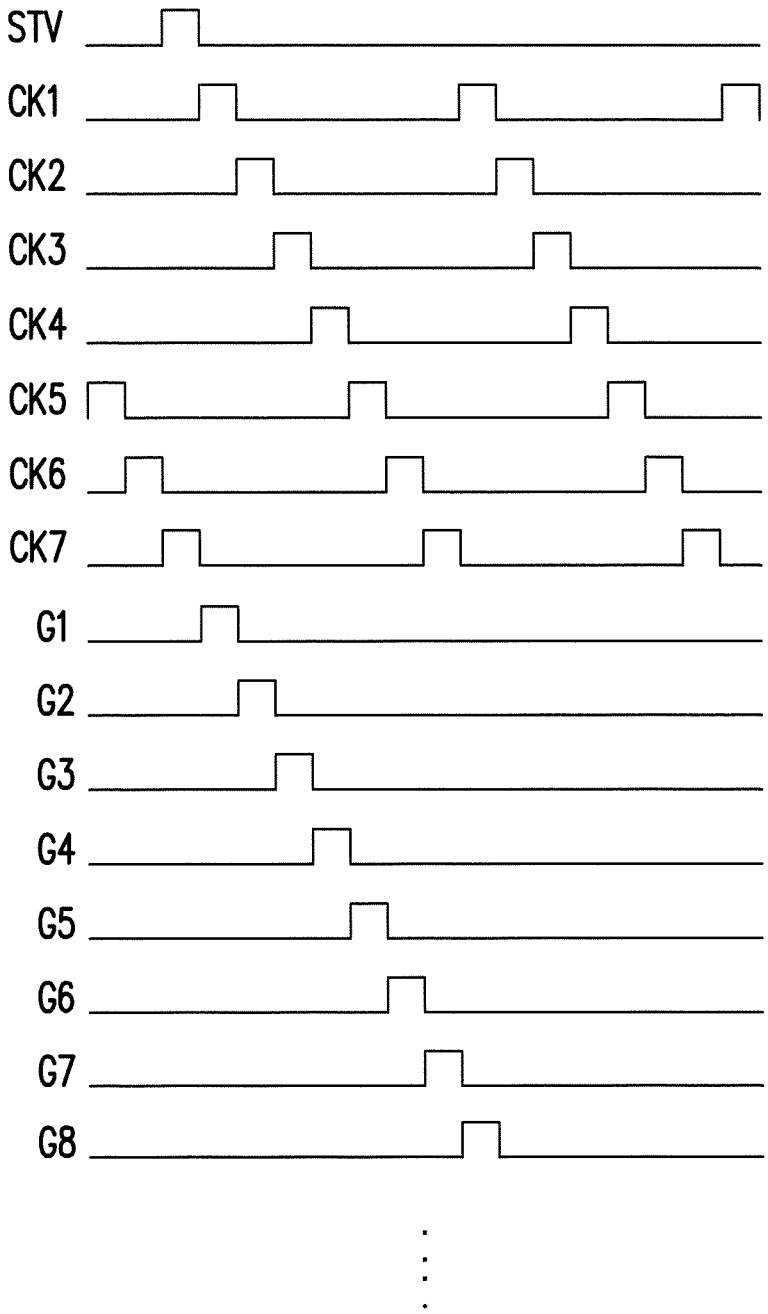
FIG. 2 is a schematic diagram illustrating an initial signal, a clock signal and a gate signal according to an embodiment of the invention.

FIG. 2 is a schematic diagram illustrating an initial signal, a clock signal and a gate signal according to an embodiment of the invention. Referring to FIG. 1 and FIG. 2, here the shift register 121_1 will be described first. In the present embodiment, the shift register 121_1 receives the initial signal STV and the clock signal CK6. When the initial signal STV is enabled, the shift registers 121_1 enables the first control signal SC11 according the initial signal STV that is enabled while disables the second control signal SC12, to turn-on the demultiplexer 123_1.

Next, the demultiplexer 123_1 turned-on will output the received clock signals CK1~CK4, and the sequentially enabled clock signals CK1~CK4 will form sequentially enabled gate signals G1~G4, wherein the gate signal G4 is transmitted to the shift register 121_2. Then, when the clock signal CK6 is enabled, the shift register 121_1 disables the first control signal SC11 according to the enabled clock signal CK6 while enables the second control signal SC12, to cut-off the demultiplexer 123_1, namely the demultiplexer 123_1 will not output the clock signals CK1~CK4.

Again, using the shift register 121_2 as an example, the shift register 121_2 receives the gate signal G4 and the clock signal CK3. When the gate signal G4 is enabled, the shift register 121_2 enables the first control signal SC21 according to the enabled gate signal G4 and disables the second control signal SC22, to turn-on the demultiplexer 123_2. Next, the demultiplexer 123_2 turned-on will output the received clock signals CK5~CK7 and CK1, and the sequentially enabled clock signals CK5~CK7 and CK1 will form sequentially enabled gate signals G5~G8, wherein the gate signal G8 is similarly transmitted to the shift register 121_3.

Later, when the clock signal CK3 is enabled, the shift register 121_2 disables the first control signal SC21 according to the enabled clock signal CK3 and enables the second control signal SC22, to cut-off the demultiplexer 123_2, namely the demultiplexer 123_2 will not output the clock signals CK5~CK7 and CK1. For the remaining shift registers (121_3~121_x) and the remaining demultiplexers (for example 123_3~123_x) reference may be made to the above, and will not be repeated here.

In the above embodiment, the shift register 121_1 receives the clock signal CK6, but in other embodiments, the shift register 121_1 may receive the clock signals CK5 or CK7, namely the clock signal (for example CK1~CK7) received by the shift register 121_1 is different than the clock signals (for example CK1~CK7) received by the demultiplexer 123_1. Furthermore, a number (corresponding to a first number) of the clock signals (for example CK1~CK7) and a number (corresponding to a second number) of the clock signals (for example CK1~CK7) received by the demultiplexers (for example 123_1~123_x) are mutually prime numbers, for each of the clock signals (for example CK1~CK7) to be provided to the shift registers (for example 121_1~121_x) in turn, to balance the electricity load of the clock signals (for example CK1~CK7).

Figure 3:
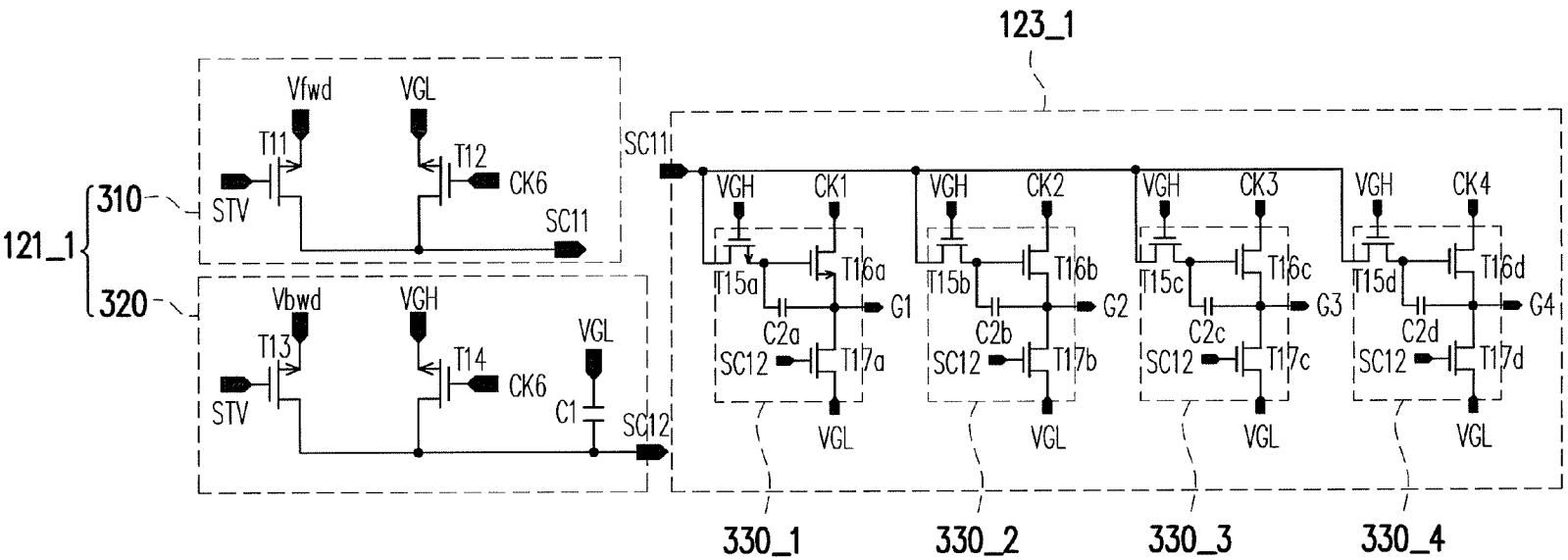
FIG. 3 is a schematic circuit diagram illustrating a shift register and a demultiplexer according to an embodiment of the invention.

FIG. 3 is a schematic circuit diagram illustrating a shift register and a demultiplexer according to an embodiment of the invention. Referring to FIG. 1 and FIG. 3, the same reference numbers are used for referring to the same or like parts. In the present embodiment, the shift register 121_1, for example, includes a first control circuit 310 and a second control circuit 320.

The first control circuit 310 receives the initial signal STV and the clock signal CK6, and enables the first control signal SC11 according to the initial signal STV, and disables the first control signal SC11 according to the clock signal CK6, wherein an enabled period of the initial signal STV does not overlap with an enabled periods of the clock signals CK1~CK4 received by the demultiplexer 123_1, and the enabled period of the initial signal STV is before the enabled periods of the clock signals CK1~CK4. The second control circuit 320 receives the initial signal STV and the clock signal CK6, and disables the second control signal SC12 according to the initial signal STV, and enables the second control signal SC12 according to the clock signal CK6.

The demultiplexer 123_1 includes a plurality of signal transmitting units (for example 330_1~330_4). The signal transmitting units 330_1~330_4 receive the first control signal SC11 and the second control signal SC12 together, and the signal transmitting units 330_1~330_4 respectively receive the clock signals CK1~CK4. Wherein, the signal transmitting units 330_1~330_4 will turn-on at the same time according to the first control signal SC11, to output the clock signals CK1~CK4 as the gate signals G1~G4, and the signal transmitting units 330_1~330_4 are cut-off at the same time according to the second control signal SC12, to stop outputting the clock signals CK1~CK4.

In more detail, the first control circuit 310 includes a transistor T11 and T12 (corresponding to a first transistor and a second transistor). A source of the transistor T11 (corresponding to a first end) receives a forward scan voltage Vfwd, and a drain of the transistor T11 (corresponding to a second end) provides the first control signal SC11, and a gate of the transistor T11 (corresponding to a control end) receives the initial signal STV. A source of the transistor T12 (corresponding to a first end) receives a gate low voltage VGL, and a drain of the transistor T12 (corresponding to a second end) is coupled to the drain of the transistor T11, and a gate of the transistor T12 receives the clock signal CK6. Wherein, the forward scan voltage Vfwd here is set as a gate high voltage VGH.

The second control circuit 320 includes a transistor T13 and T14 (corresponding to a fourth transistor and a fifth transistor) and a first capacitor C1. A source of the transistor T13 (corresponding to a first end) receives a backward scan voltage Vbwd, and a drain of the transistor T13 (corresponding to a second end) provides the second control signal SC12, and a gate of the transistor T13 (corresponding to a control end) receives the initial signal STV. A source of the transistor T14 (corresponding to a first end) receives the gate high voltage VGH, and a drain of the transistor T14 (corresponding to a second end) is coupled to the drain of the transistor T13, and a gate of the transistor T14 (corresponding to a control end) receives the clock signal CK6. The first capacitor C1 is coupled between the gate low voltage VGL and the drain of the transistor T13. Wherein the backward scan voltage Vbwd here is set as the gate low voltage VGL.

The signal transmitting units 330_1~330_4 are roughly the same, and here, the signal transmitting unit 330_1 will be described as an example. In the present embodiment, the signal transmitting unit 330_1 includes transistors T15*a*, T16*a*, T17*a* (corresponding to a seventh transistor to a ninth transistor) and a second capacitor C2*a*. A drain of the transistor T15*a* (corresponding to a first end) receives the first control signal SC11, and a gate of the transistor T15*a* (corresponding to a control end) receives the gate high voltage VGH. A drain of the transistor T16*a* (corresponding to a first end) receives the clock signal CK1, and a source of the transistor T16*a* (corresponding to a second end) provides the gate signal G1, and a gate of the transistor T16*a* (corresponding to a control end) is coupled to the source of the transistor T15*a* (corresponding to the second end). The second capacitor C2*a* is coupled between the gate and source of the transistor T16*a*. A drain of the transistor T17*a* (corresponding to a first end) is coupled to the source of the transistor T16*a*, and a source of the transistor T17*a* (corresponding to a second end) receives the gate low voltage VGL, and a gate of the transistor T17*a* (corresponding to a control end) receives the second control signal SC12.

The signal transmitting unit 330_2 includes transistors T15*b*, T16*b*, T17*b* and a second capacitor C2*b*, wherein the difference between the signal transmitting units 330_1 and 330_2 lies in a drain of the transistor T16*b* receives the clock signal CK2 and a source of the transistor T16*b* provides the gate signal G2. The signal transmitting unit 330_3 includes transistors T15*c*, T16*c*, T17*c* and a second capacitor C2*c*, wherein the difference between the signal transmitting units 330_1 and 330_3 lies a drain of the transistor T16*c* receives the clock signal CK3 and a source of the transistor T16*c* provides the gate signal G3. The signal transmitting unit 330_4 includes transistors T15*d*, T16*d*, T17*d* and a second capacitor C2*d*, wherein the difference between the signal transmitting units 330_1 and 330_4 lies a drain of the transistor T16*d* receives the clock signal CK4 and a source of the transistor T16*d* provides the gate signal G4.

The circuit structures of the shift registers 121_2~121_*x* are roughly the same with that of the shift register 121_1. The difference between the shift register 121_1 and 121_2 lies in the gate of the transistors T11 and T13 of the shift register 121_2 receives the gate signal G4 (corresponding to a first gate signal), and the gate of the transistors T12 and T14 of the shift register 121_2 receives the clock signal CK3 (corresponding to a first clock signal), namely the first control circuit 310 and the second control circuit 320 of the shift register 1212 receives the gate signal G4 and the clock signal CK3 to provide the first control signal SC21 and the second control signal SC22. For the circuit structures of the remaining shift registers (for example 121_3~121_*x*) reference may be made to FIG. 1 and FIG. 3 for understanding and will not be repeated here.

Figure 4:
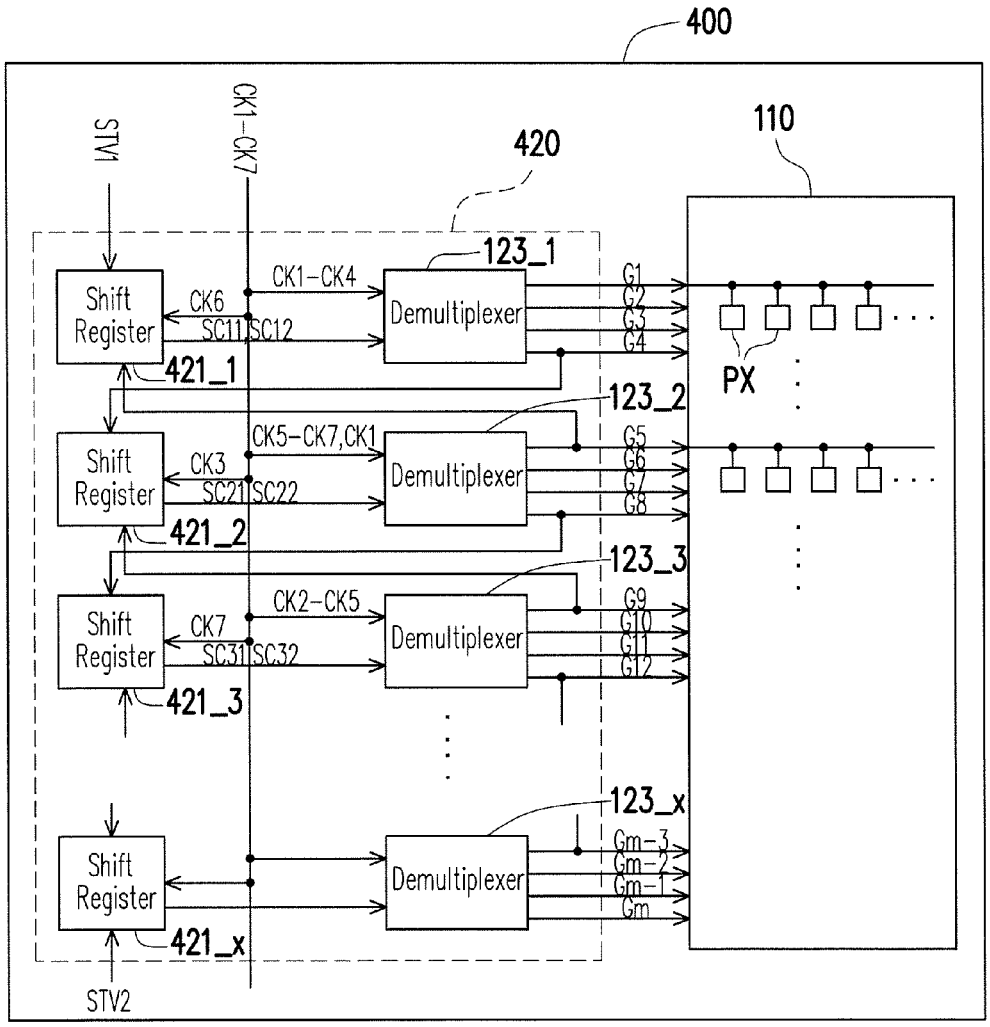
FIG. 4 is a schematic diagram illustrating a system for a display panel according to another embodiment of the invention.

FIG. 4 is a schematic diagram illustrating a system for a display panel according to another embodiment of the invention. Referring to FIG. 1 and FIG. 4, the same reference numbers are used for referring to the same or like parts. A display panel 400 is roughly the same as the display panel 100, wherein the difference lies in shift registers 421_1~421_*x* of a gate driver circuit 420 of the display panel 400. In the present embodiment, in regards to the order of the forward scan, the shift registers 421_1~421_*x* aside from receiving the last gate signals provided by the gate signal generating unit of the previous stage, they further receive the first gate signals provided by the gate signal generating unit of the next stage.

In other words, the display panel 100 is a unidirectional scan display panel, and the display panel 400 is a bidirectional scan display panel. More specifically, when the display panel 400 performs a forward scan, the shift registers 421_1~421_*x* are controlled by the initial signal STV1 and sequentially started according to the order of the shift registers 421_1~421_*x*; when the display panel 400 performs a backward scan, the shift registers 421_1~421_*x* are controlled by the initial signal STV2 and sequentially started according to the order of the shift registers 421_*x*~421_1. Furthermore, when each of the shift registers 421_1~421_*x* are started, the first control signal (for example SC11~SC31) for enabling and the second control signal (for example SC12~SC32) for disabling are provided; when each of the shift registers 421_1~421_*x* are closed, the first control signal (for example SC11~SC31) for disabling and the second control signal (for example SC12~SC32) for enabling are provided.

Figure 5:
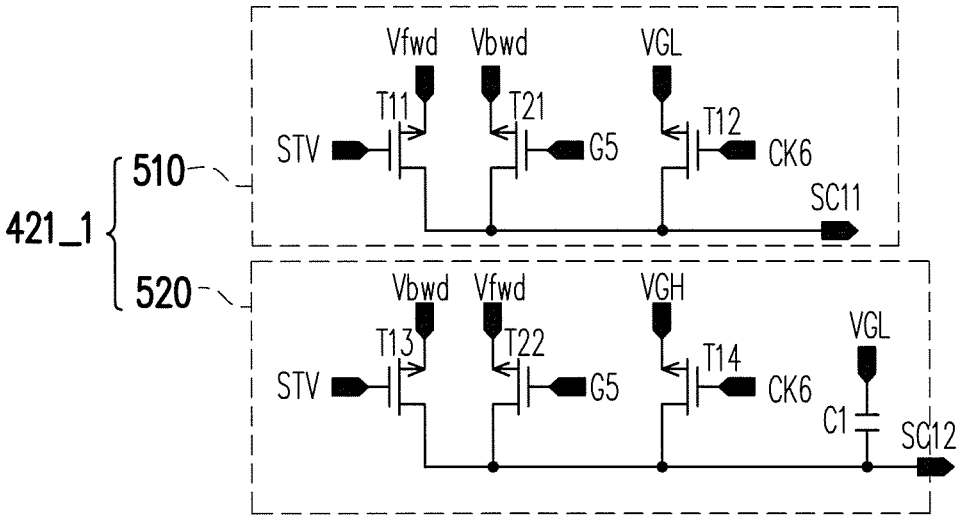
FIG. 5 is a schematic circuit diagram illustrating a shift register and a demultiplexer according to another embodiment of the invention.

FIG. 5 is a schematic circuit diagram illustrating a shift register according to another embodiment of the invention. Referring to FIG. 3 and FIG. 5, the same reference numbers are used for referring to the same or like parts. In the present embodiment, the shift register 421_1, for example, includes a first control circuit 510 and a second control circuit 520. The first control circuit 510 is roughly the same as the first control circuit 310, wherein the difference lies in the first control circuit 510 further includes a transistor T21 (corresponding to the third transistor). A source of the transistor T21 (corresponding to a first end) receives the backward scan voltage Vbwd, and a drain of the transistor T21 (corresponding to a second end) is coupled to the drain of the transistor T11, and a gate of the transistor T21 (corresponding to a control end) receives the gate signal G5. Wherein an enabled period of the gate signal G5 does not overlap with an enabled period of the clock signals CK1~CK4.

The second control circuit 520 is roughly the same as the second control circuit 320, wherein the difference lies in the second control circuit 520 further includes a transistor T22 (corresponding to a sixth transistor). A source of the transistor T22 (corresponding to a first end) receives the forward scan voltage Vfwd, and a drain of the transistor T22 (corresponding to a second end) is coupled to the drain of the transistor T13, and a gate of the transistor T22 (corresponding to a control end) receives the gate signal G5.

In the present embodiment, the forward scan voltage Vfwd is different than the backward scan voltage Vbwd, and the forward scan voltage Vfwd and the backward scan voltage Vbwd are respectively the gate high voltage VGH and the gate low voltage VGL. More specifically, when the display panel 400 performs a forward scan, the forward scan voltage Vfwd is set as the gate high voltage VGH and the backward scan voltage Vbwd is set as the gate low voltage VGL. When the display panel 400 performs a backward scan, the forward scan voltage Vfwd is set as the gate low voltage VGL and the backward scan voltage Vbwd is set as the gate high voltage VGH.

In summary, a display panel of the embodiments of the invention divides a gate driver circuit into shift registers for controlling timing and demultiplexers for outputting a plurality of clock signals, namely sharing the same group of control circuits. In this way, the number of transistors disposed on the gate driver circuit of the display panel may be reduced, to narrow the border of the display panel. Also, by setting the number of clock signals, the clock signals may be provided to the shift registers in turn to balance the electricity load of the clock signals.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display panel, comprising:

a pixel array, having a plurality of pixels;

a gate driver circuit, coupled with the pixels to provide a plurality of gate signals, comprising:

a plurality of shift registers, respectively receiving a first gate signal of the gate signals and a first clock signal of a plurality of clock signals, to respectively provide a first control signal and a second control signal, wherein the clock signals are sequentially enabled; and a plurality of demultiplexers, respectively receiving a plurality of second clock signals of the clock signals, and are coupled to the corresponding one of the shift registers to receive the first control signal and the second control signal provided by the corresponding one of the shift registers, wherein each of the demultiplexers are turned-on according to the first control signal provided by the corresponding one of the shift registers, to provide the gate signals according to the second clock signals, and each of the demultiplexers are cut-off according to the second control signal provided by the corresponding one of the shift registers, wherein each of the shift registers comprising:

a first control circuit, receiving the first gate signal and the first clock signal, to enable the first control signal according to the first gate signal, and disable the first control signal according to the first clock signal, wherein an enabled period of the first gate signal does not overlap with an enabled period of the corresponding one of the second clock signal, wherein the first control circuit comprises:

a first transistor, having a first end receiving a forward scan voltage, a second end providing the first control signal, and a control end receiving the first gate signal; and a second transistor, having a first end receiving a gate low voltage, a second end coupled to the second end of the first transistor, and a control end receiving the first clock signal; and a second control circuit, receiving the first gate signal and the first clock signal, to disable the second control signal according to the first gate signal, and enable the second control signal according to the first clock signal.

2. The display panel as claimed in claim 1, wherein the first control circuit further comprises:

a third transistor, having a first end receiving a backward scan voltage, a second end coupled to the second end of the first transistor, and a control end receiving a second gate signal of the gate signals, wherein the forward scan voltage is different than the backward scan voltage, and an enabled period of the second gate signal does not overlap with the enabled period of the corresponding one of the second clock signals.

3. The display panel as claimed in claim 1, wherein the second control circuit comprises:

a fourth transistor, having a first end receiving a backward scan voltage, a second end providing the second control signal, and a control end receiving the first gate signal;

a fifth transistor, having a first end receiving a gate high voltage, a second end coupled to the second end of the fourth transistor, and a control end receiving the first clock signal; and a first capacitor, coupled between a gate low voltage and the second end of the fourth transistor.

4. The display panel as claimed in claim 3, wherein the second control circuit further comprises:

a sixth transistor, having a first end receiving a forward scan voltage, a second end coupled to the second end of the fourth transistor, and a control end receiving a second gate signal of the gate signals, wherein the forward scan voltage is different than the backward scan voltage, and an enabled period of the second gate signal does not overlap with an enabled period of the corresponding one of the second clock signals.

5. The display panel as claimed in claim 1, wherein each of the demultiplexers comprises:

a plurality of signal transmitting units, receiving the second clock signals, the first control signal and the second control signal, wherein the signal transmitting units turn-on at the same time according to the first control signal, to output the second clock signals as the corresponding ones of the gate signals, and the signal transmitting units are cut-off at the same time according to the second control signal.

6. The display panel as claimed in claim 5, wherein each of the signal transmitting units comprises:

a seventh transistor, having a first end receiving the first control signal, a second end, and a control end receiving a gate high voltage;

an eighth transistor, having a first end receiving the corresponding one of the second clock signals, a second end providing the corresponding one of the gate signals, and a control end coupled to the second end of the seventh transistor;

a second capacitor, coupled between the control end of the eighth transistor and the second end of the eighth transistor; and a ninth transistor, having a first end coupled to the second end of the eighth transistor, a second end receiving a gate low voltage, and a control end receiving the second control signal.

7. The display panel as claimed in claim 1, wherein the second clock signals received by each of the demultiplexers are different than the first clock signal received by the corresponding one of the shift register.

8. The display panel as claimed in claim 1, wherein a first number of the clock signals and a second number of the second clock signals received by each of the demultiplexers are mutually prime numbers.

* * * * *